US006223785B1

(12) United States Patent
Barden

(10) Patent No.: US 6,223,785 B1
(45) Date of Patent: May 1, 2001

(54) APPARATUS FOR MAKING REINFORCING CAGES

(76) Inventor: Wayne Barden, 60 Dingyarra St., Toogoolawah Queensland 4313 (AU)

( * ) Notice: Subject to any disclaimer, the term of this patent is extended or adjusted under 35 U.S.C. 154(b) by 0 days.

(21) Appl. No.: 09/458,288

(22) Filed: Dec. 10, 1999

(30) Foreign Application Priority Data

Dec. 10, 1998 (AU) ..... PP7588

(51) Int. Cl.[7] ..... B21F 27/10
(52) U.S. Cl. ..... 140/112
(58) Field of Search ..... 140/92.2, 112

(56) References Cited

U.S. PATENT DOCUMENTS

| | | | | |
|---|---|---|---|---|
| 3,209,793 | * | 10/1965 | Miura | 140/112 |
| 4,018,251 | | 4/1977 | Mundel et al. . | |
| 4,160,146 | | 7/1979 | Mundel et al. . | |
| 5,665,254 | * | 9/1997 | Isono et al. | 140/112 |

FOREIGN PATENT DOCUMENTS

| | | |
|---|---|---|
| 1552159 | 5/1970 | (DE) . |
| 2631450 | 12/1977 | (DE) . |
| 2631455 | 1/1978 | (DE) . |
| 3611482 | 10/1987 | (DE) . |
| 3809420 | 8/1989 | (DE) . |
| 3934791 | 5/1991 | (DE) . |
| 19812266 | 9/1998 | (DE) . |
| 0035477 | 9/1991 | (EP) . |
| 0552455 | 7/1993 | (EP) . |
| 2014960 | 4/1970 | (FR) . |
| 1338027 | 11/1973 | (GB) . |
| 1146754 | 11/1986 | (IR) . |
| 1234263 | 5/1992 | (IT) . |

* cited by examiner

*Primary Examiner*—Lowell A. Larson
(74) *Attorney, Agent, or Firm*—Renner, Otto, Boisselle & Sklar LLP

(57) ABSTRACT

An apparatus for making a reinforcing cage as disclosed. The apparatus has a former for receiving a plurality of longitudinally extending reinforcing rods and the former is rotatably received on a bed carried by a frame. An unloading module is located adjacent the former and has a shuttle for moving towards the former for feeding rods into the former and away from the former for withdrawing the rods as a cage is made. A feed is present adjacent the former for directing a reinforcing rod against the rod as they are withdrawn from the former to allow the spiral rod to be welded to the longitudinal rods as to produce a reinforcing cage.

19 Claims, 6 Drawing Sheets

APPARATUS FOR MAKING REINFORCING CAGES

BACKGROUND OF THE INVENTION

This invention relates to an apparatus for making reinforcing cages for reinforcing concrete.

Reinforcing cages have a plurality of longitudinally extending reinforcing rods defining a square, circular or other configuration when viewed in transverse section. The rods are maintained in their configuration by bands extending about the rods and at locations along the length of the rods. These bands typically are circular and are welded to the rods. Sometimes a continuous spiral band is employed.

The manufacture of such cages is particularly labour intensive and typically is achieved with the aid of a stationary jig which maintains the longitudinally extending rods at a desired spacing and configuration relative to one another. A series of bands are placed at intervals along the length of the rods and progressively welded to the rods to complete the cage. Partial disassembly of the jig was necessary to remove the finished cage from the jig. Alternatively a band was secured in place and the rods were withdrawn slightly from the jig and further bands were secured in place.

This method of manufacturing reinforcing cages was particularly labour intensive and as a consequence the resultant cages were expensive to manufacture.

SUMMARY OF THE INVENTION

It is an object of the present invention to provide an apparatus for making reinforcing cages which at least minimises the disadvantages referred to above.

According to one aspect of the invention there is provided an apparatus for making reinforcing cages, the apparatus having a frame, a former for receiving a plurality of longitudinally extending reinforcing rods, a bed on which the former may rest for rotation relative to the bed, a drive for rotating the former, a loading module located adjacent the former and having a shuttle mounted for longitudinal reciprocal movement towards and away from the former, a feed for feeding a reinforcing rod in a spiral fashion as the cage is made, whereby the shuttle may feed reinforcing rods into the former as it moves towards the former and may withdraw reinforcing rods from the former as a reinforcing rod is wound in a spiral fashion about the withdrawn reinforcing rods.

The former may include a plurality of rod supporting members. The rod supporting members may be located at discrete locations along the rods. Alternatively, the supporting members may extend along the rods for a predetermined distance.

In an alternative embodiment, the former may consist of a plurality of spaced interconnected plates with each of the plates having supports for reinforcing rods. The supports may be arranged in any desired pattern relative to the plates. For example the pattern may be square, rectangular, triangular or any other shape dictated by the shape of the reinforcing cage required. The supports may comprise apertures in the plates.

Preferably, the supporting members are tubes. The tubes may be parallel to one another and arranged to form any desired shape when viewed in transverse section or end on. Preferably, the supporting tubes are arranged to define a circular shape when viewed end on.

Preferably the tubes are secured relative to one another by bands located at intervals along the length of the tubes.

The tubes each have a bore which freely receives a reinforcing rod and which allows the rods to be easily drawn through the tubes.

The bed may include one or more drive members for engaging the former so that the former may be rotated. The drive members may comprise drive rollers.

The drive may continuously rotate the former or may rotate the former in a stepwise fashion. Stepwise drive is preferred. The drive may include a drive motor coupled either directly or indirectly to the drive member or members. Preferably, the drive motor indirectly drives the drive members via a gear box.

The former is preferably biased towards the drive members. One or more press wheels may be used for this purpose.

BRIEF DESCRIPTION OF THE DRAWINGS

A particular preferred embodiment of the invention will now be described by way of example with reference to the drawings in which.

DESCRIPTION OF THE PREFERRED EMBODIMENT

Figure 1:
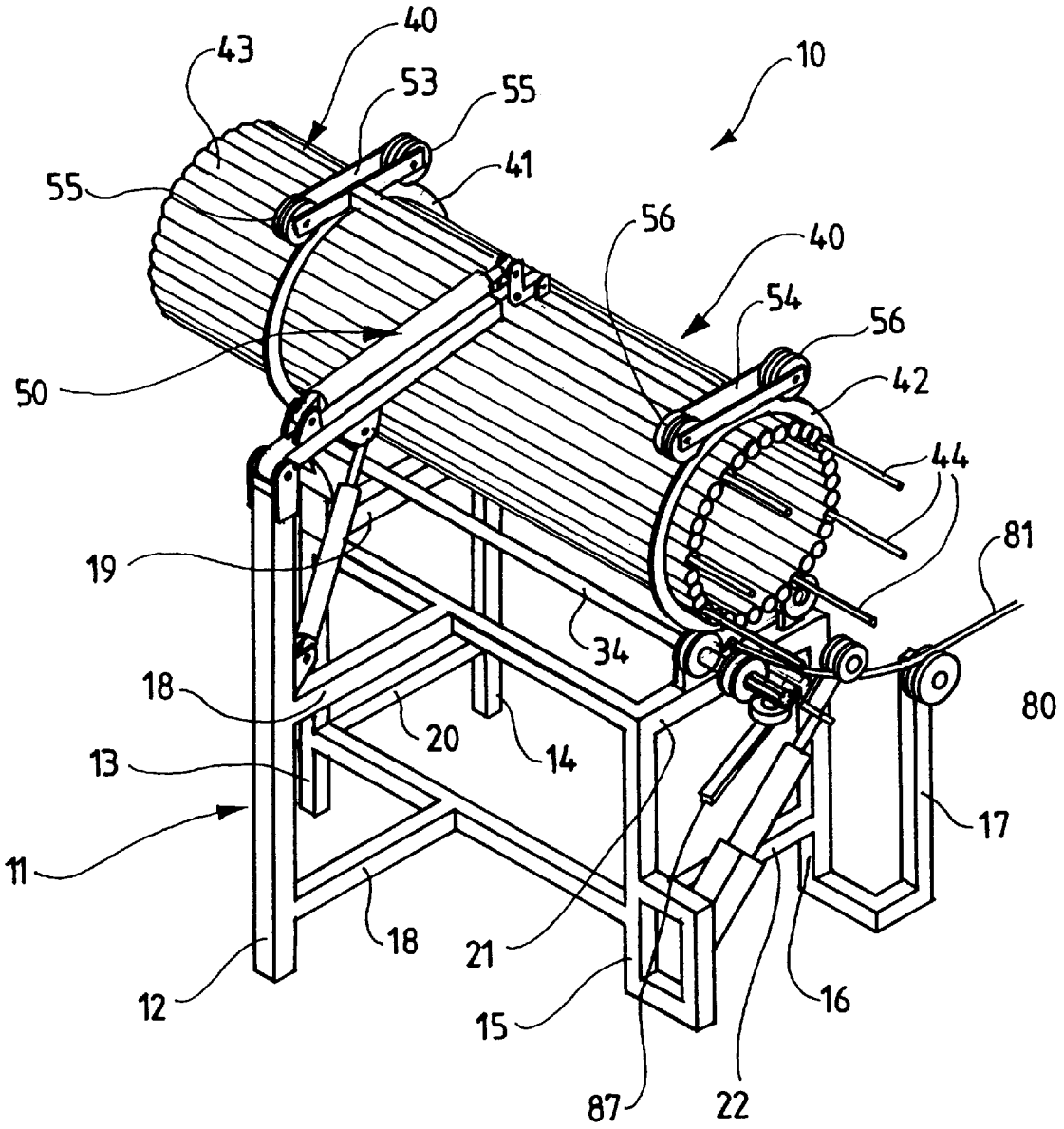
FIG. 1 is a perspective view of an apparatus for making reinforcing cages according to one embodiment of the invention.

The apparatus 10 shown in FIG. 1 has a frame 11 consisting of upright frame members 12, 13, 14, 15, 16 and 17 which terminate in ground engaging legs. Cross frame members 18, 19, 20, 21 and 22 extend between various ones of the upright frame members.

Figure 2:
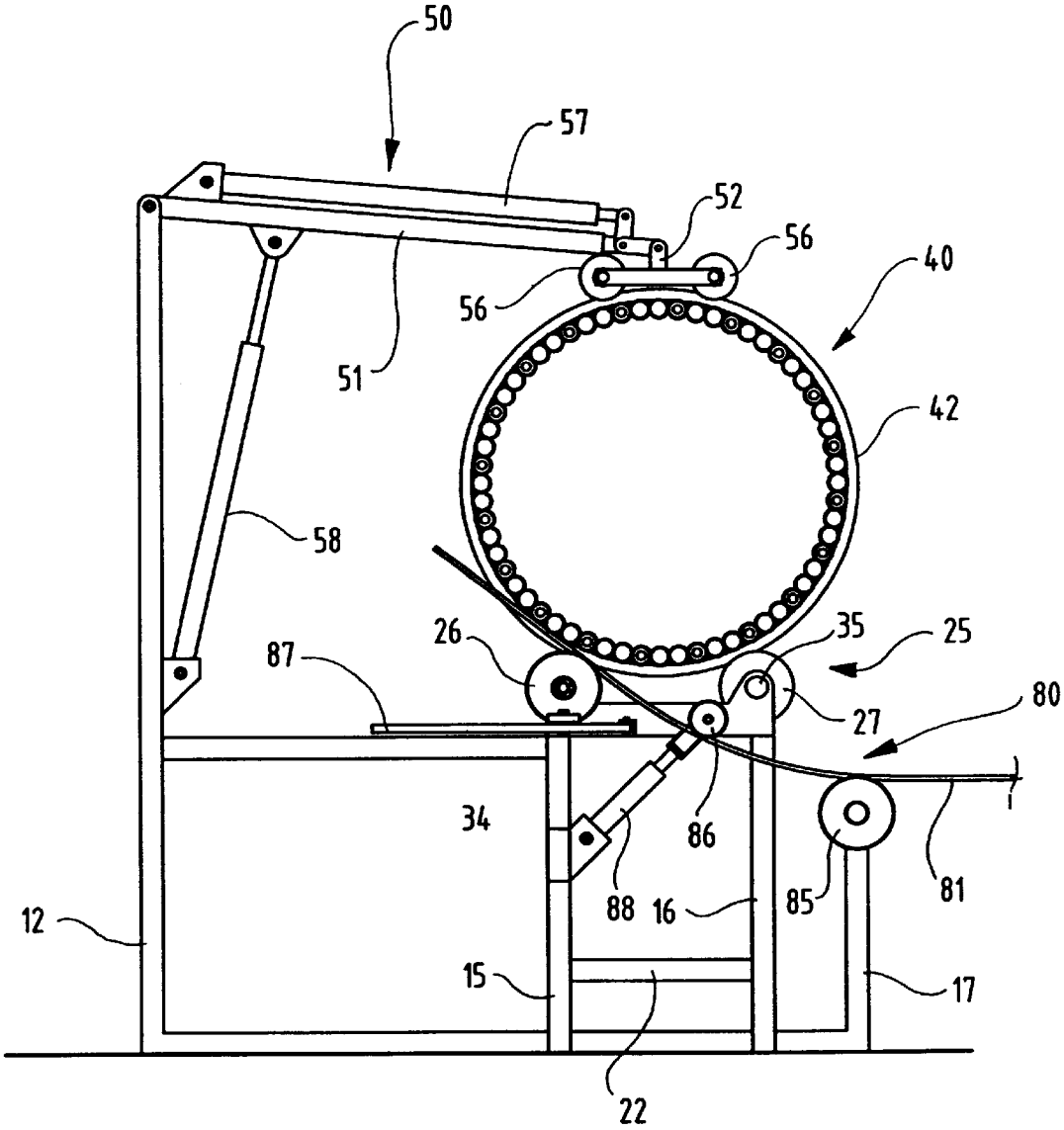
FIG. 2 is an end view from one end of the apparatus of FIG. 1.
Figure 3:
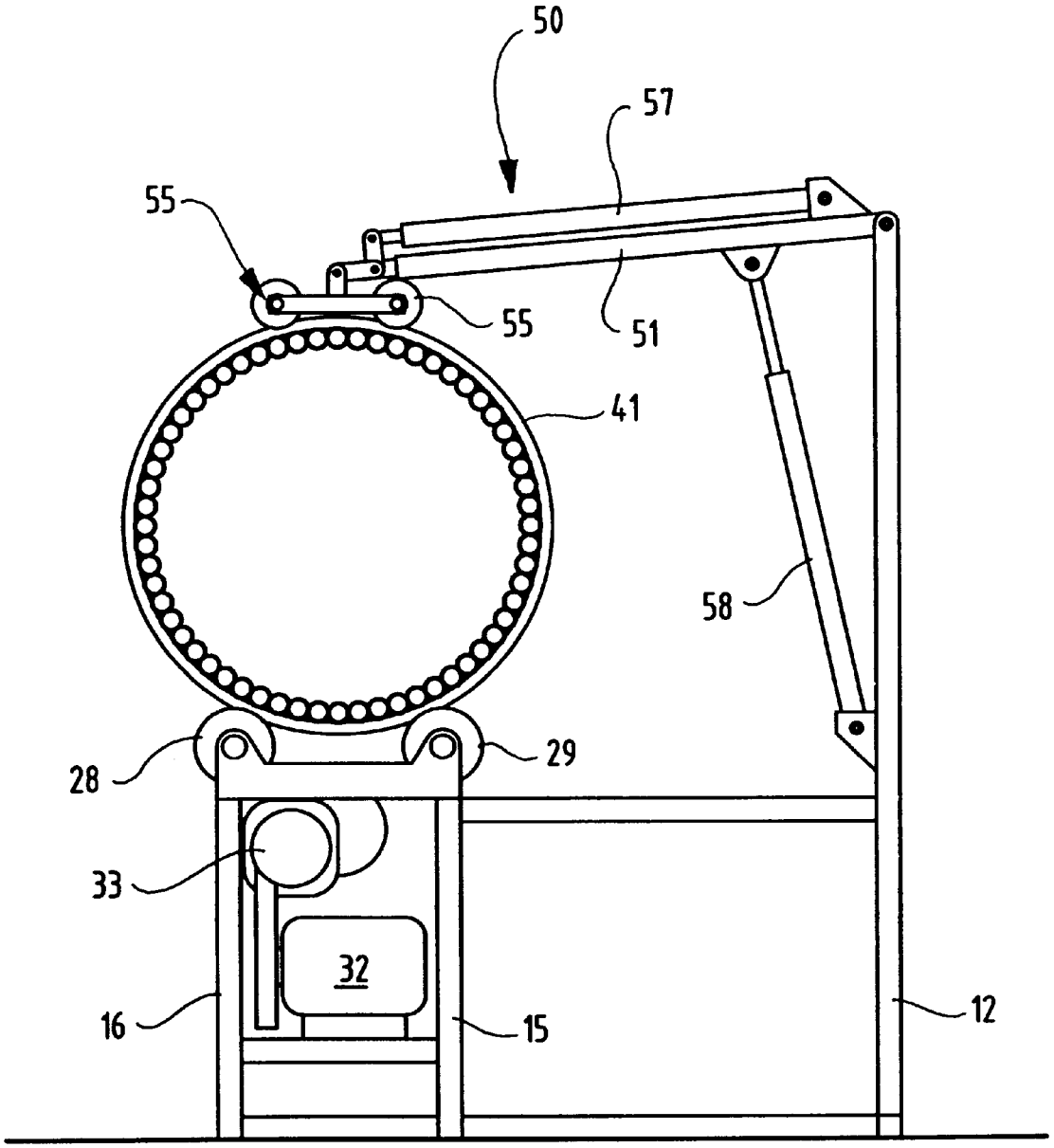
FIG. 3 is an end view from the opposite end of the apparatus of FIG. 1.

The apparatus 10 includes a bed 25 provided by rollers 26, 27 and 28, 29 (see FIGS. 2 and 3). The rollers are driven by a motor 32 and a gear box 33 (see FIG. 3). Shaft 34 extends between rollers 26 and 29 whilst shaft 35 extends between rollers 27 and 28.

A former 40 rests upon the bed and has rings 41, 42 which rest upon the rollers 28, 29 and 26, 27 to allow the former to be rotated. The former 40 consists of a plurality of tubes 43 adapted to receive longitudinally extending reinforcing rods 44.

An adjustable press assembly 50 is pivotally coupled to upright 12. The assembly has an arm 51 which telescopically receives a member 52 which extends along the former 40.

Cross members 53 and 54 carry press wheels 55, 56 which are biased against rings 41 and 42 to maintain the former on the bed.

As shown in FIG. 2 the press wheel assembly includes a telescopic support arm parallel to arm 51. The telescopic possibility of arms 51 and 57 allow the press wheels to accommodate a variety of different sizes of formers. Cylinder assembly 58 extends between arm 51 and upright 12 and biases the press wheels against the former.

As shown in FIGS. 1 and 2 the apparatus includes a feed 80 which allows a length of reinforcing rod 81 applied from a roll (not shown) to be directed towards the former and against rods 44 to allow the rod 81 to be welded to the rods 44. The feed includes a guide roller 85 supported by upright 17, a guide roller 86 and a lever 87 for directing the rod 81 against rods 44. Roller 86 is adjustably mounted relative to a cylinder assembly 88. By extending or retracting the cylinder assembly 88 the position of roller 86 may be altered.

Figure 4:
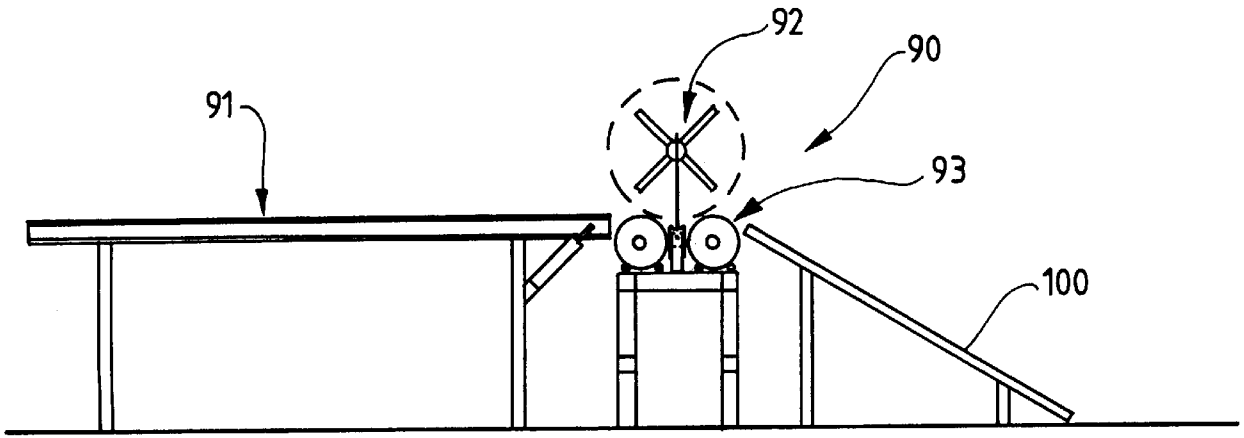
FIG. 4 is an end view of a loading module used with the apparatus of FIGS. 1 to 3.

FIG. 4 shows an end view of a loading module 90 which forms part of the apparatus of the invention. The module 90 has a table 91 upon which reinforcing rods like those identified by the numeral 44 may rest. A shuttle 92 is mounted for reciprocal movement along a shuttle support 93. The shuttle 92 has outwardly directed hooked members 94 and an upright guide 95. A ramp 100 is located on the opposite side of the shuttle 92 to the table 91.

Figure 5:
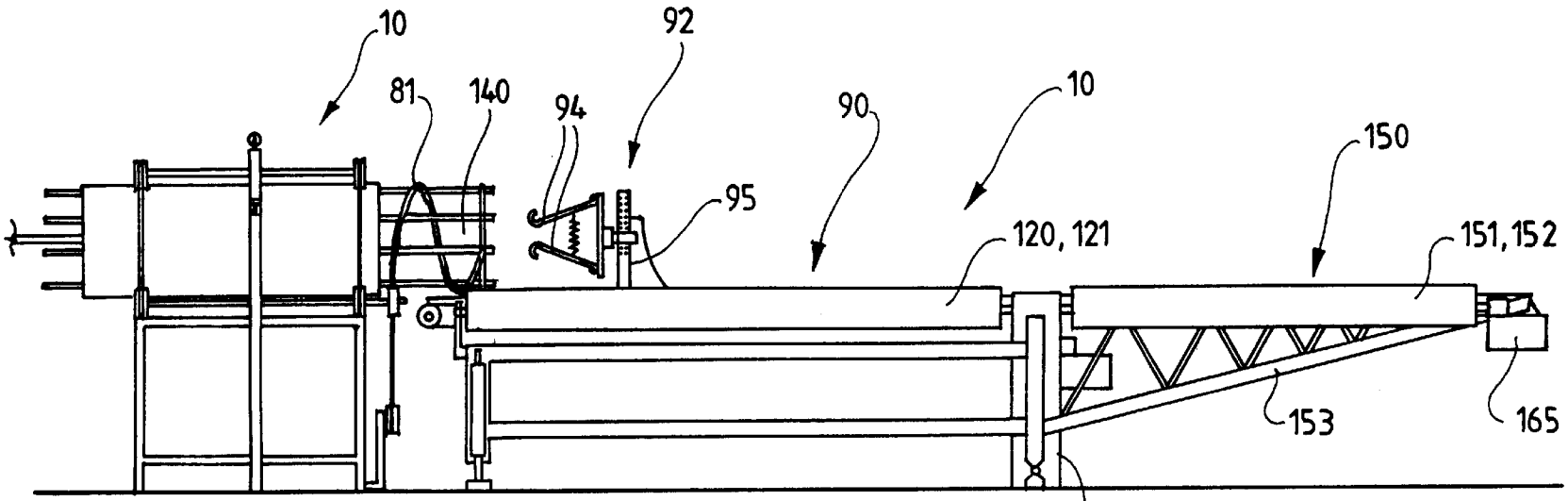
FIG. 5 is a side view of the apparatus of FIG. 1 and of the module of FIG. 4.

As shown in FIG. 5, an extension 150 may be present at an end of the table 91 to allow the apparatus to be used for making reinforcing cages of particular lengths.

FIG. 5 shows greater detail of the shuttle 92. Longitudinally extending support rollers 120, 121 receive and support a reinforcing cage as it is made in the apparatus. The rollers 120, 121 are rotatably received on rollers 122, 123.

A track 124 receives an end of the upright 95. That end of the upright terminates in opposed guides 125, 126 received within oppositely directed longitudinally extending rails 127, 128. Longitudinally extending guide rails 129, 130 extend around the rails 127, 128 and have an inwardly and downwardly extending upper surface.

The shuttle has a chain or cable 131 attached to it. The chain forms a continuous loop and a lower part of the loop is received within a guard 132.

As shown in FIG. 5 cantilevered support 150 forms an extension to he rotatable support rollers 120, 121 and consist of two rollers 151, 152 which extend parallel to one another and form axial extensions to rollers 120, 121. Only roller 151 is visible in this view. A framework 153 supports the rollers 151, 152.

Rollers 120 and 121 are linked to each other by a drive member located within housing 160. The housing 160 includes a drive for operating the drive member so that the rollers 120, 121 may be driven.

Figure 6:
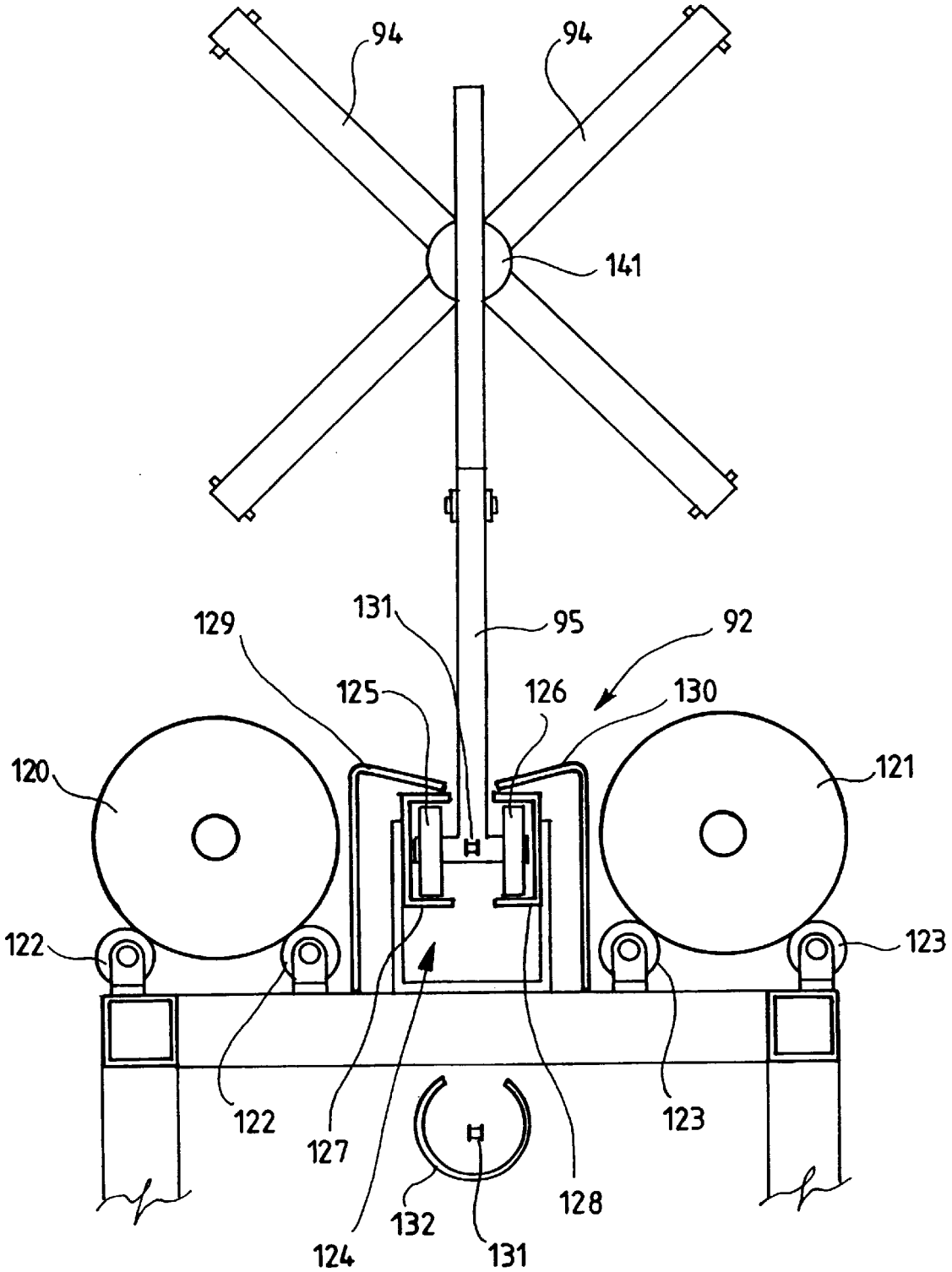
FIG. 6 is a detailed end view of the module of FIG. 4.
Figure 7:
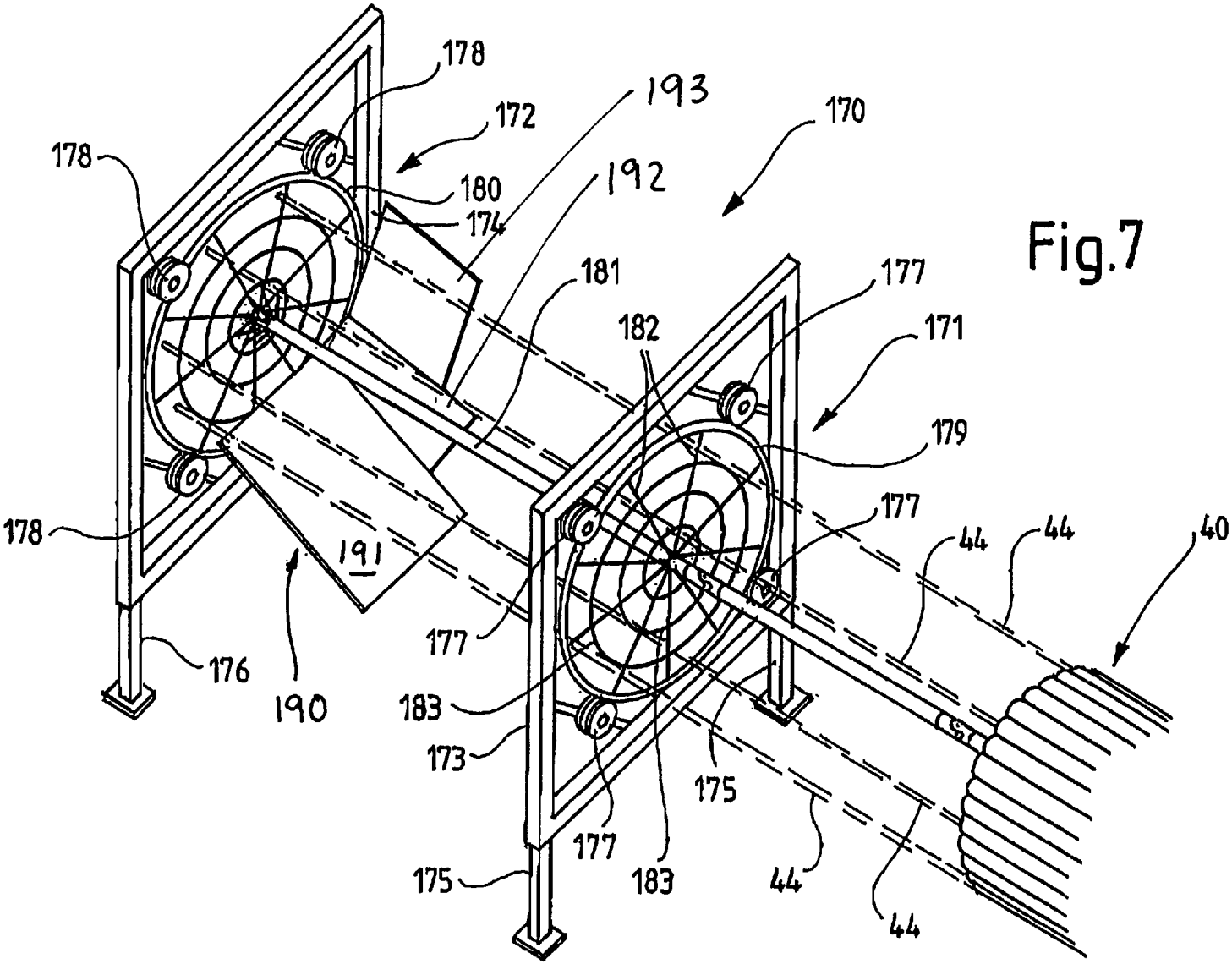
FIG. 7 shows a perspective view of a reinforcing rod support assembly.

The chain 131 shown in FIG. 6 is driven by a drive 165.

The support assembly 170 is located at an end of the former opposite to the loading module 90. The assembly 170 includes two support spiders 171, 172 which each consist of a frame 173, 174 having height adjustable legs 175, 176. The frames 173, 174 carry rollers 177, 178 for rotatably receiving support discs 179, 180. The discs 179, 180 are linked by a drive shaft 181 which extends into the former 40 and is linked to the former 40 so that when the former rotates, so do the discs 179, 180. Guide plates 190 consists of plates 191, 192 and 193 and is arranged at an inclined angle adjacent support spider 172. The guide is contacted by ends of the rods 44 as they are fed through the former 40 and directs the end of the rods into supporting engagement with disc 180.

Reinforcing rods 44 extend through the former 40 and are supported by the discs 179, 180. Each disc has radial support members 182 and concentric support rings 183.

The operation of the apparatus 10 is as follows. The shuttle 92 is moved to an extreme right hand position when viewed in FIG. 5. Reinforcing rods 44 are placed on the table 91 and are allowed to progress one by one over rail 127 and down the inclined surface until one locates forwardly of the upright 95. The shuttle 92 is then driven to the left of FIG. 4 to ensure that the rod 44 is received within a selected one of the tubes 43 of the former 40. The shuttle is then returned to the right hand side position and the former 40 is rotated through a predetermined arc. A further rod 44 is then allowed to rest in front of upright 95 and the shuttle is moved to the left of FIG. 5 to cause the rod 44 to locate inside a selected tube 43. This process is continued until the desired tubes 43 have been loaded with rods 44.

Once the desired rods 44 have been loaded a ring 140 is welded to the rods. The former may be rotated in a stepwise fashion to allow this to be done. The shuttle 92 is then moved to the left of FIG. 5 to allow the hooked members 94 to engage the ring 140. The shuttle 92 may then be moved progressively to the right of FIG. 5 to draw the rods 44 from the tubes 43 of the former. The hooked members 94 are rotatably mounted at 141 to the upright (see FIG. 6) and as the rods 44 are withdrawn the former 40 is rotated and reinforcing rod 81 is caused to be wound in a spiral fashion on to the rods 44. The rod 81 is welded onto the rods as the rods 44 are withdrawn and in this way a reinforcing cage is produced.

Once the cage is finished the hooked members 94 are released from the ring 140 and the completed cage is caused to travel down the ramp 100 and the process may then be recommenced to produce another cage.

The former in the apparatus of the invention may be used to produce cages of any desired transverse profile.

What is claimed is:

1. An apparatus for making reinforcing cages, the apparatus having a frame, a former for receiving a plurality of longitudinally extending reinforcing rods, a bed on which the former may rest for rotation relative to the bed, a drive for rotating the former, a loading module located adjacent the former and having a shuttle mounted for longitudinal reciprocal movement towards and away from the former, a feed for feeding a reinforcing rod in a spiral fashion as the cage is made, whereby the shuttle may feed reinforcing rods into the former as it moves towards the former and may withdraw the reinforcing rods from the former as a reinforcing rod is wound in a spiral fashion about the withdrawn reinforcing rods.

2. The apparatus of claim 1 wherein the former includes a plurality of reinforcing rod supporting members.

3. The apparatus of claim 2 wherein the supporting members consist of tubes.

4. The apparatus of claim 3 wherein the tubes are circumferentially spaced from one another and are held to define a cylindrical former by two longitudinally spaced rings which extend about the tubes.

5. The apparatus of claim 1 including a press assembly adapted to bias the former onto the bed.

6. The apparatus of claim 1 wherein the drive includes two pairs of rollers driven by the drive and on which the former rests.

7. The apparatus of claim 1 wherein the feed includes guide rollers and a lever for directing the reinforcing rod in a spiral fashion about the reinforcing rods extending from the former.

8. The apparatus of claim 1 wherein the loading module includes a table adjacent the shuttle onto which reinforcing rods may be positioned and presented to allow the shuttle to feed the rods onto the former.

9. The apparatus of claim 8 wherein the loading module includes longitudinally extending rails along which the shuttle may be driven for movement towards and away from the former.

10. The apparatus of claim 9 wherein the shuttle includes an upright member having one end receivable by the rails and a plurality of hooked members rotatably received by the upright member.

11. The apparatus of claim 8 including a pair of longitudinally extending support rollers arranged on opposed sides of the shuttle on which the reinforcing cage is rotatably supported as the shuttle moves away from the former.

12. The apparatus of claim 11 wherein the support rollers are driven by a drive.

13. The apparatus of claim 11 including a cantilevered support extending from one end of the loading module and for forming an extension to the loading module.

14. The apparatus of claim 13 including a drive carried by the cantilevered support and a drive chain extending between that drive and the shuttle.

15. The apparatus of claim 8 including an unloading ramp on one side of the shuttle opposite the table.

16. The apparatus of claim 1, including a support assembly adjacent the former for supporting the reinforcing rods introduced into the former.

17. The apparatus of claim 16 wherein the support assembly includes support spiders consisting of frames and support discs rotatably received by the frames.

18. The apparatus of claim 16 wherein the support discs and the former are linked by a drive shaft and rotate in unison.

19. The apparatus of claim 18 including a guide adjacent one of the discs for directing ends of the rods which project through the former into supporting engagement with the one support disc.

* * * * *